US009096412B2

(12) United States Patent
Bloch et al.

(10) Patent No.: US 9,096,412 B2
(45) Date of Patent: Aug. 4, 2015

(54) FIRE SERVICE ELEVATOR

(75) Inventors: Hanspeter Bloch, Buchrain (CH); Lukas Zeder, Huddinge (SE)

(73) Assignee: Inventio AG, Hergiswil (CH)

( * ) Notice: Subject to any disclaimer, the term of this patent is extended or adjusted under 35 U.S.C. 154(b) by 391 days.

(21) Appl. No.: 13/555,650

(22) Filed: Jul. 23, 2012

(65) Prior Publication Data

US 2013/0037354 A1 Feb. 14, 2013

(30) Foreign Application Priority Data

Aug. 10, 2011 (EP) ..... 11177055

(51) Int. Cl.
*B66B 11/02* (2006.01)
*E04D 13/04* (2006.01)

(52) U.S. Cl.
CPC ..... *B66B 11/0226* (2013.01); *E04D 13/0404* (2013.01); *E04D 2013/0436* (2013.01)

(58) Field of Classification Search
CPC ..... B66B 11/0226; E04D 13/0404; E04D 2013/0436
USPC ..... 187/401; 52/12, 13, 15, 16, 202, 514, 52/515
IPC ..... B66B 11/02, 19/00; E04D 13/04
See application file for complete search history.

(56) References Cited

U.S. PATENT DOCUMENTS 6,129,838 A * 10/2000 Millner ..... 210/164
6,530,722 B1 * 3/2003 Shaw et al. ..... 405/52
7,310,921 B2 * 12/2007 Williams ..... 52/746.11
7,897,235 B1 * 3/2011 Locher et al. ..... 428/76
2012/0031712 A1 * 2/2012 Bloch et al. ..... 187/401
2012/0255814 A1 * 10/2012 Bloch et al. ..... 187/401

FOREIGN PATENT DOCUMENTS

GB 2482970 A * 2/1998 ..... E04D 13/04
JP 52049548 A * 4/1977 ..... B66B 7/00
JP 52133640 A * 11/1977 ..... B66B 11/02
JP 06144749 A * 5/1994 ..... B66B 11/02
JP 06191745 A * 7/1994 ..... B66B 1/06
JP 08290879 A * 11/1996 ..... B66B 11/02
JP 09240966 A * 9/1997 ..... B66B 11/02
JP 10292545 A * 11/1998 ..... E04D 13/04
JP 2004-115251 A 4/2004
JP 2004292122 A * 10/2004 ..... B66B 11/02
JP 2005041619 A * 2/2005 ..... B66B 11/02

(Continued)

OTHER PUBLICATIONS

AIPN, Machine Translation, JP 2004115251 A, Sep. 30, 2014, p. 1-8.*

(Continued)

*Primary Examiner* — Michael Mansen
*Assistant Examiner* — Stefan Kruer
(74) *Attorney, Agent, or Firm* — Fraser Clemens Martin & Miller LLC; William J. Clemens

(57) ABSTRACT

A fire service elevator has an elevator cage, which includes a cage roof, wherein the cage roof has a seal in which at least one drain is arranged. The drain is so arranged in the seal that extinguishing water collecting on the cage roof in the case of a fire flows away from the cage roof substantially only via the drain.

15 Claims, 4 Drawing Sheets

(56) References Cited

FOREIGN PATENT DOCUMENTS

| | | |
|---|---|---|
| JP | 2009-190843 A | 8/2009 |
| WO | 2011/085911 A1 | 7/2011 |

OTHER PUBLICATIONS

AIPN, Machine Translation, JP 20050141619 A, Sep. 30, 2014, p. 1-7.*
AIPN, Machine Translation, JP 06191745 A, Sep. 30, 2014, p. 1-3.*
AIPN, Machine Translation, JP 06 144 749 A, Dec. 23, 2014, p. 1-4.*
AIPN, Machine Translation, JP 08 290 879 A, Mar. 18, 2015, pp. 1-4.*
AIPN, Machine Translation, JP 09 240 966 A, Mar. 18, 2015, pp. 1-7.*
AIPN, Machine Translation, JP 2004 292 122 A, Mar. 18, 2015, pp. 1-4.*
AIPN, Machine Translation, JP 10 292 545 A, Mar. 18, 2015, pp. 1-8.*

* cited by examiner

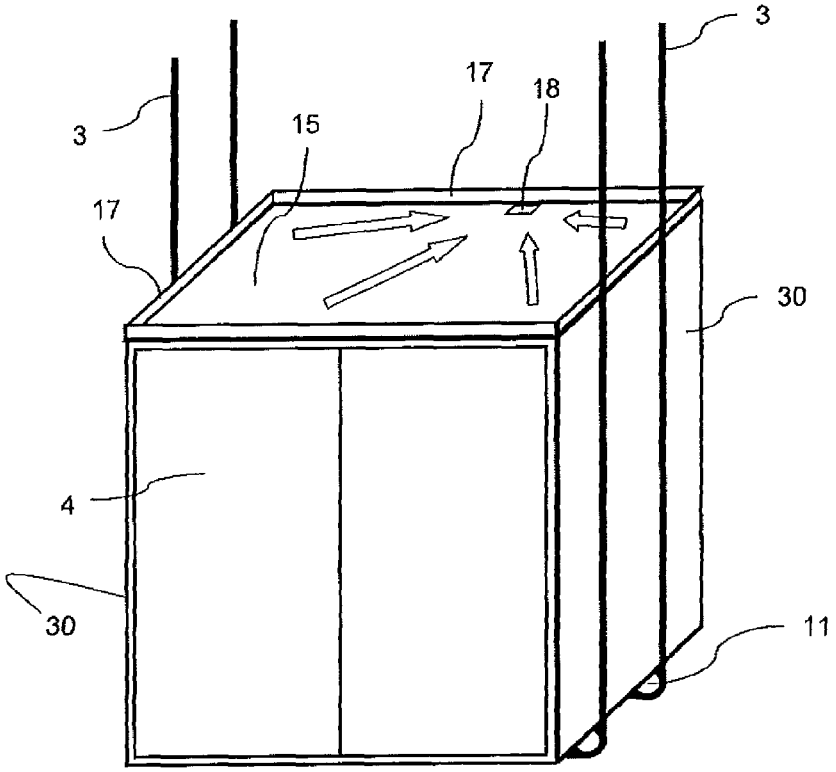
Figure 2
Figure 3a
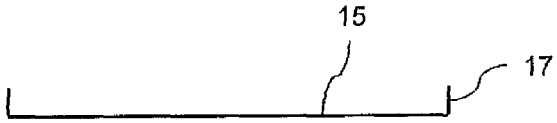
Figure 3b
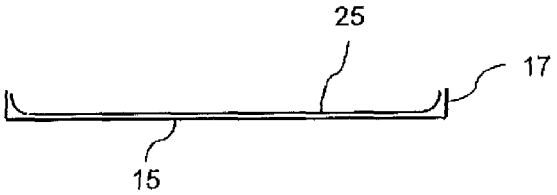
Figure 3c
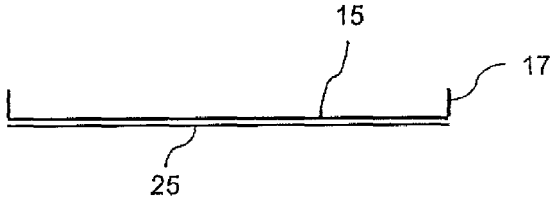

FIRE SERVICE ELEVATOR

CROSS-REFERENCE TO RELATED APPLICATION

This application claims priority to European Patent Application No. 11177055.8, filed Aug. 10, 2011, which is incorporated herein by reference.

FIELD

The present disclosure relates to a fire service elevator.

BACKGROUND

Modern elevator installations or so-called fire service elevators, which are designed additionally for this purpose, can help ensure reliable operation even in the case of fire. On the one hand evacuation of persons and/or material, which is at risk, from the stories affected by the fire should be ensured and on the other hand a functionally capable elevator also should be available for the transport of fire service personnel and their extinguishing material. In both cases the use of extinguishing water should not have the consequence that the elevator installation or the fire service elevator no longer functions. This applies not only to the use of a sprinkler installation on a story, but also to the use of extinguishing water by the fire service.

This means that electric components of the elevator installation should remain dry. Moreover, it should be ensured that a support means is still driven as intended on a drive pulley. Extinguishing water can in that case negatively influence the traction of the support means on the drive pulley. On the one hand, extinguishing water can directly reduce the coefficients of friction between the drive pulley and the support means and on the other hand lubricant present in the extinguishing water can in addition negatively influence the traction between the support means and the drive pulley. A support means wetted by extinguishing water can thus lead to a reduction of traction or even to a complete loss of traction. Particularly in the case of a substantial difference between the weight of the elevator cage and a counterweight, an uncontrolled travel of the elevator cage can in that case arise, which has to be stopped by safety brakes.

The use of belt-like support means instead of steel cables can have the problem of additionally emphasizing the loss of traction between support means and drive pulley. In the case of wetting by extinguishing water the synthetic material surfaces of belt-like support means change their traction characteristics more strongly than support means of steel cable form. This can make it necessary to conduct away the extinguishing water in controlled manner or to catch it. It can be necessary to prevent traction means sections which co-operate with the drive pulley from being wetted by extinguishing water.

The extinguishing water normally penetrates via the shaft doors of the elevator shaft into the elevator shaft. In that case the extinguishing water flows onto a story floor below the shaft doors through into the elevator shaft.

SUMMARY

At least some embodiments comprise a device which protects electronic components of the elevator installation as well as support means from extinguishing water and which can be realized economically.

In some embodiment, a fire service elevator has an elevator cage, which comprises a cage roof, wherein the cage roof is formed to be substantially horizontal and wherein the cage roof has a seal in which at least one drain is arranged. The drain is so arranged in the seal that extinguishing water collecting on the cage roof in the case of a fire flows away from a cage roof substantially only via the drain.

An elevator cage designed in that way can provide that all extinguishing water which collects on the cage roof is prevented by the seal from flowing away to places not intended for that purpose. Through a suitable arrangement of the seal and the drain it can thus be achieved that the support means and the electronic components or also other water-sensitive components are not wetted by extinguishing water collecting on the cage roof.

This can include arranging a drain system at the outset not at the individual shaft doors, but at the elevator cage itself. This concept derives from recognition that the extinguishing water does not in principle have to be kept away from the elevator shaft, but can also flow away in controlled or deflected manner. It was observed that a main reason for the electronic components and the support means becoming wet is an uncontrolled flowing of the extinguishing water away from the roof of the elevator cage.

In some embodiments the seal is the surface of in the cage roof. This can mean that no additional elements have to be arranged at the cage roof for sealing. In addition, the design of the drain can thereby be simplified, because a drain in such a cage roof opens the cage roof and the seal simultaneously.

Alternatively thereto, an additional sealing element can be provided which is arranged above or below the cage roof. Such additional sealing elements can be retrofitted economically to already existing elevator installations. In addition, other cage roof constructions do not have to be changed and equally can be retrofitted.

In another embodiment the seal covers substantially the entire area of the cage roof. This can mean that extinguishing water is conducted from all regions of the cage roof in the desired paths.

In another embodiment the cage roof comprises overflow protection means arranged around the cage roof so that the extinguishing water is prevented from flowing away from the cage roof at the sides. This can mean that extinguishing water collecting on substantially horizontal surfaces of the cage roof cannot flow laterally away from the cage roof.

So as not to limit travel of the elevator cage in the direction of the shaft head, the overflow protection means is possibly constructed in such a manner that in a use state it does not project beyond other components of the elevator cage. The height of the overflow protection means is, for example, at most 50 centimeters, possibly at most 20 centimeters, possibly at most 10 centimeters.

In another embodiment the drain is constructed as a notch or an opening in the overflow protection means. Discharge of the extinguishing water outside the elevator cage, for example, can thereby be achieved. Alternatively thereto the drain can also be constructed as an opening in the seal and possibly also in the cage roof if the seal and the cage roof are designed as separate elements. It is thereby possible, for example, to achieve discharge of the extinguishing water within the elevator cage.

In an exemplifying form of embodiment separating elements which divide the cage roof into a plurality of sectors are arranged on the cage roof, wherein the separating elements have throughflow openings so that extinguishing water can flow from each sector in the direction of the drain. Such separating elements can, for example, be components of the elevator on the cage roof or boundaries between regions of the cage roof with different functions.

In further embodiments a guide element is so arranged at the drain that extinguishing water flowing through the drain is conducted onward by the guide element. This can mean that an outflow path of the extinguishing water below the cage roof can be better controlled so that the extinguishing water is, for example, kept by the guide element away from water-sensitive components. In addition, with the help of such a guide element it is possible to achieve better control of how and where the extinguishing water leaves the elevator cage and flows on downwardly into the elevator shaft.

In another embodiment a cage floor is sealed so that extinguishing water collecting on the cage floor substantially cannot flow through the cage floor. Possibly, in that case the elevator cage is so designed that the extinguishing water flows away from the cage floor into the elevator shaft via a cage apron. The cage apron is arranged below cage doors. In this embodiment the extinguishing water collecting on the cage floor thus flows through the elevator cage onto the cage floor and via the cage apron back into the elevator shaft. This can mean that the extinguishing water is predominantly kept to one side of the shaft, namely at that shaft wall in which the shaft doors are arranged. A wide dispersion of the extinguishing water in the shaft can thereby be prevented.

In another embodiment the guide element is arranged within the elevator cage so that the extinguishing water is guided from the cage roof into the elevator cage via the guide element. In another embodiment the guide element is arranged outside the elevator cage so that the extinguishing water is guided from the cage roof past the elevator cage by way of the guide element. The guide element can thus be arranged in accordance with the respectively desired discharge direction of the extinguishing water.

In at least some cases, more significant modifications or, in particular, constructional measures do not have to be undertaken either at the elevator itself or at the elevator shaft. The proposed sealed cage roof with drain can, for example, also be retrofitted to existing elevator installations.

In some embodiments, elevator cages of different types can be retrofitted. The seal can in principle be arranged on planar, chamfered and even irregularly shaped cage roofs. This enables retrofitting of the extinguishing water drain system according to many elevator types. The seal with drain can thus be interpreted as an additional component which can be arranged on existing, intrinsically closed elevator cages.

Possibly, an elevator cage constructed is used in fire service elevators which have support means with a synthetic material casing, such as, for example, belts and/or in which electronic components are arranged in the elevator cage. In the case of support means without a synthetic material encasing, such as, for example, steel cables, an elevator cage can also be used, but here the traction loss due to wetting of the support means by extinguishing water is less serious than in the case of support means encased by synthetic material. Such belts usually have a casing of synthetic material arranged around a plurality of tensile carriers disposed parallel to one another. The tensile carriers can be constructed from, for example, steel wires or synthetic fibers. Equally, an elevator cage can also be used in elevators which do not have electronic components in the elevator cage.

Several support means extending parallel to one another can be arranged, wherein in one form of embodiment each of these support means loops under the elevator cage. Each of the parallel extending support means possibly runs along the opposite side walls of the elevator cage.

In other embodiments, the fire service elevator is designed in such a manner that the elevator cage in an operating state reaches speeds of more than 1 meter per second. This can mean that, in the case of fire, rescue maneuvers can be carried out efficiently and quickly. In some embodiments the elevator cage in an operating state reaches speeds of more than 2 meters per second, possibly more than 3 meters per second.

In other embodiments the elevator cage additionally comprises a ladder. In some embodiments the ladder is arranged at a cage back wall. A ladder arranged outside the elevator cage has the advantage that rescue work outside the elevator cage in the case of fire is simplified.

Fire service elevators are elevators which have special adaptations so that they can remain capable of use longer in the case of fire. Such adaptations are, for example, electronic components protected against spray water, fireproof cage elements or a specific control mode for the case of fire. The seal with drain is similarly such an adaptation. In this sense, any elevator which is equipped with such a seal with drain is termed fire service elevator in the following.

BRIEF DESCRIPTION OF THE DRAWINGS

The disclosed technologies are explained in more detail symbolically and by way of example by way of figures, in which:

FIG. 2 shows an exemplifying form of embodiment of an elevator cage;

FIG. 3*a* shows an exemplifying form of embodiment of a cage roof with seal;

FIG. 3*b* shows an exemplifying form of embodiment of a cage roof with seal;

FIG. 3*c* shows an exemplifying form of embodiment of a cage roof with seal;

DETAILED DESCRIPTION

Figure 1:
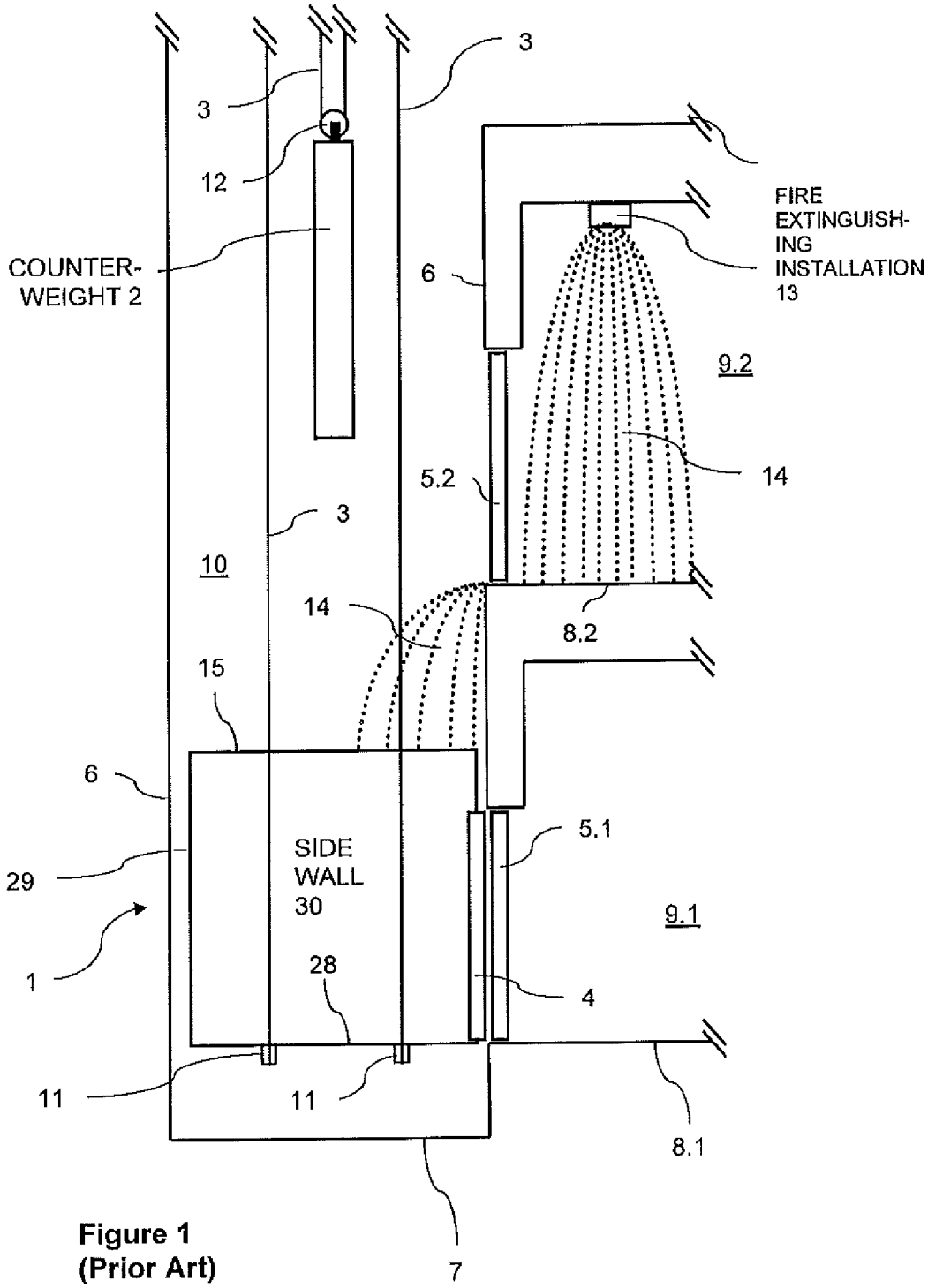
Figure 1 (Prior Art)
FIG. 1 shows a schematic illustration of an exemplifying elevator installation in a building with a fire extinguishing installation.

FIG. 1 shows an elevator installation such as is known from the prior art. A cage 1 and a counterweight 2 are arranged in an elevator shaft 10. In that case, both the elevator cage 1 and the counterweight 2 are coupled with a support means 3. The elevator cage 1 and the counterweight 2 can be vertically moved in the shaft 10 by driving the support means 3 by a drive (not illustrated). In the illustrated embodiment not only the elevator cage 1, but also the counterweight 2 are suspended at support rollers 11, 12. The cage support rollers 11 are in that case arranged below the cage 1 so that the cage 1 is looped under by the support means 3. By contrast thereto the counterweight support roller 12 is arranged above the counterweight 2 so that the counterweight 2 is suspended at the counterweight support roller 12. Through the looping-under of the elevator cage 1 the support means 3 is guided along cage side walls 30.

A shaft wall 6 has a respective opening at the height of each story 9.1, 9.2, which opening can be closed by a respective shaft door 5.1, 5.2. A fire extinguishing installation 13 is installed on the second-lowermost story 9.2. The fire extinguishing installation 13 is arranged at a ceiling of the story 9.2 so that extinguishing water 14 can reach the largest possible number of fire locations. The extinguishing water 14 collects on the story floor 8.2 and flows from there, at least partly, through under the shaft door 5.2 and into the elevator shaft 10. As illustrated in FIG. 1, the extinguishing water 14 flowing through the shaft door 5,2 can drop in the manner of a waterfall from above onto the elevator cage 1. From the elevator cage 1 the extinguishing water 14 flows further down until it collects at the shaft floor 7 (not illustrated).

The distribution of the extinguishing water 14 in the elevator shaft 10 is dependent on, inter alia, the following factors: For entry of the extinguishing water 14 into the elevator shaft 10 the extinguishing water quantity and also a gap size between the shaft door 5.2 and the story floor 8.2 can be important. The larger the quantity of extinguished water, the greater the water pressure which can shoot the extinguishing water into the shaft. The shape and size of the gap between the shaft door 5.2 and the story floor 8.2 have a direct influence on the distribution of the extinguishing water 14 in the elevator shaft 10. In addition, the distribution of the extinguishing water 14 in the elevator shaft 10 is influenced by the height difference between the elevator cage 1 and the story 9.2 from which the extinguishing water 14 penetrates into the shaft 10. The greater the spacing between a cage roof 15 and the story floor 8.2 from which the extinguishing water 14 penetrates into the shaft 10 the more rapidly the extinguishing water 14 falls onto the elevator cage roof 15 and the further the extinguishing water 14 is sprayed from the cage roof 15. A larger spacing between the cage roof 15 and the story floor 8.2 from which the extinguishing water penetrates into the shaft 10 additionally has the consequence that the extinguishing water can propagate more widely and deeply in the shaft 10 due to a higher drop path.

It is apparent from FIG. 1 that the extinguishing water 14 when flowing away from the cage roof 15 should not, as far as possible, to flow along the cage side walls 30, so as to prevent wetting of the support means 3 by extinguishing water 14. In addition, the extinguishing water should flow away from the cage roof 15 or from the elevator cage 1 in such a manner that electronic components disposed in or at the elevator cage 1 or in the elevator shaft 10 do not come into contact with extinguishing water 14.

It will be evident that the principles and problems described with respect to FIG. 1 also occur with different kinds of fire extinguishing installations 13 and different kinds of elevators.

FIG. 2 shows an exemplifying form of embodiment of an elevator cage in three-dimensional illustration. The elevator cage is looped under by two support means 3, wherein the support means 3 are guided by support rollers 11 around the elevator cage.

The elevator cage has a cage door 4, two cage side walls 30, a cage back wall (not visible in this illustration), a cage floor (not visible in this illustration) and a cage roof 15.

The cage roof 15 has a seal and a drain 18. In addition, an overflow protection means 17 is arranged at sides of the cage roof 15. The overflow protection means 17 prevents extinguishing water from flowing away from the cage roof 15 at the sides. It is indicated by arrows how extinguishing water collecting on the cage roof 15 flows away from the cage roof 15 via the drain 18.

Different embodiments of a cage roof 15 with a seal are illustrated in cross-section in FIGS. 3*a* to 3*c*. FIG. 3*a* shows a cage roof 15 with overflow protection means 17, wherein the seal is the surface of in the cage roof 15. FIG. 3*b* shows a cage roof 15 with overflow protection means 17, wherein the seal 25 is arranged above the cage roof 15. FIG. 3*c* shows a cage roof 15 with overflow protection means 17, wherein the seal 25 is arranged below the cage roof 15. As apparent from FIGS. 3*a* and 3*b*, the seal can additionally also be arranged at the overflow protection means 17. Alternatively thereto the seal can be arranged, as illustrated in FIG. 3*c*, only at the cage roof 15 and not at the overflow protection means 17. Depending on the respective design of the overflow protection means 17, for example the respective material and mode of fastening to the cage roof 15, it is not necessary to arrange the seal 25 at the overflow protection means 17.

Figure 4A:
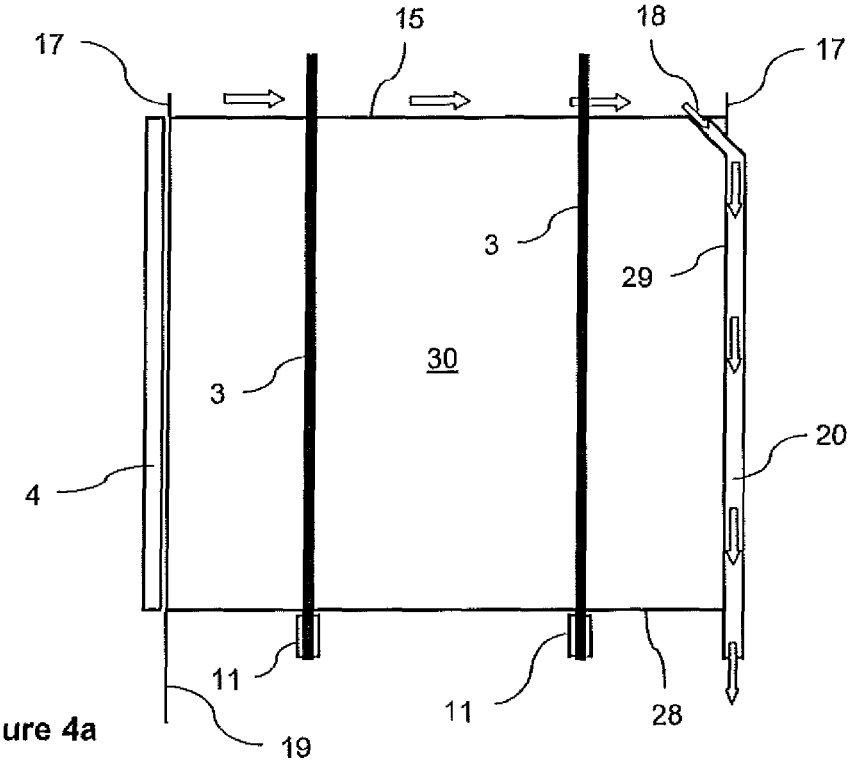
FIG. 4*a* shows an exemplifying form of embodiment of an elevator cage with drain and guide element.
Figure 4B:
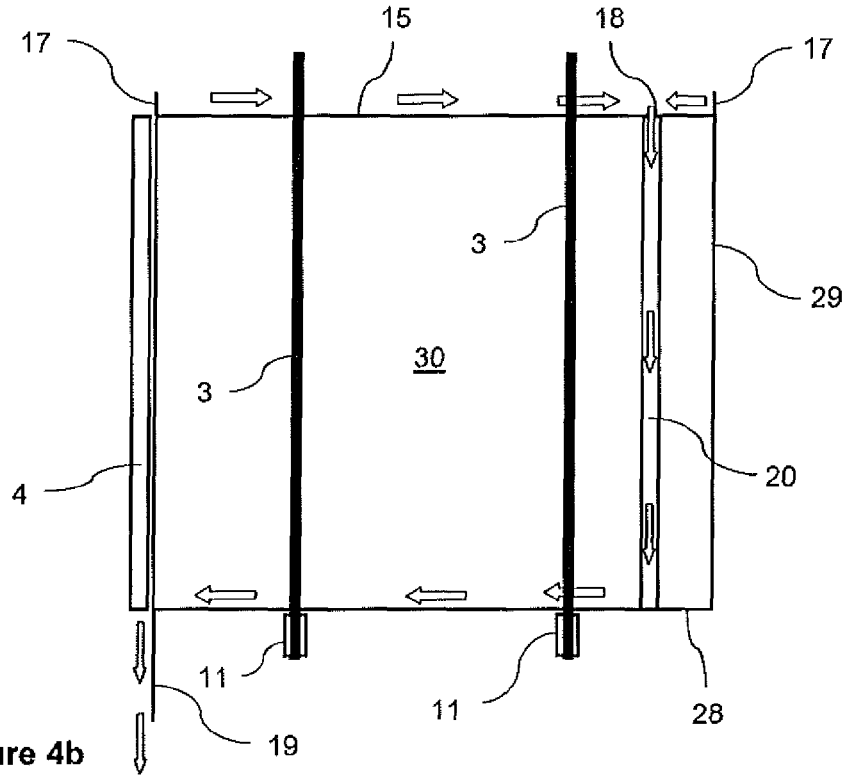
FIG. 4*b* shows an exemplifying form of embodiment of an elevator cage with drain and guide element.

FIGS. 4*a* and 4*b* each show an elevator cage in side view. The elevator cage comprises in each instance a cage door 4, a cage back wall 29, cage side walls 30, a cage floor 28, a cage roof 15 with seal, drain 18 and overflow protection means 17, as well as cage support rollers 11. In addition, the elevator cage has a cage apron 19 which serves the purpose of closing an opening in a shaft door below the elevator cage if the elevator cage is positioned above a normal stopping point at a story.

The elevator cage in each instance additionally comprises a guide element 20 which is arranged at the drain 18 in such a manner that extinguishing water flowing away from the cage roof 15 through the drain 18 flows on through the guide element 20.

In this connection FIG. 4*a* shows a first exemplifying form of embodiment of an elevator cage. Here the guide element 20 is arranged outside at the cage back wall 29 so that the extinguishing water is guided past the elevator cage and at the end of the guide element 20 drops down into the elevator shaft.

In this connection FIG. 4*b* shows a second exemplifying form of embodiment of an elevator cage. Here the guide element 20 is arranged within the elevator cage so that the extinguishing water is conducted into the elevator cage and at the end of the guide element 20 flows onto the cage floor 28. The cage floor 28 is sealed off so that the extinguishing water flows out of the elevator cage under the cage door 4 and flows on down from the elevator cage by way of the cage apron 19.

Figure 5A:
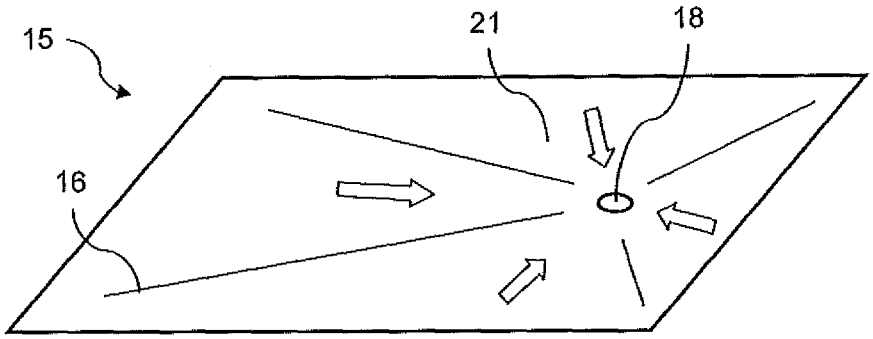
FIG. 5*a* shows an exemplifying form of embodiment of a cage roof with drain.
Figure 5B:
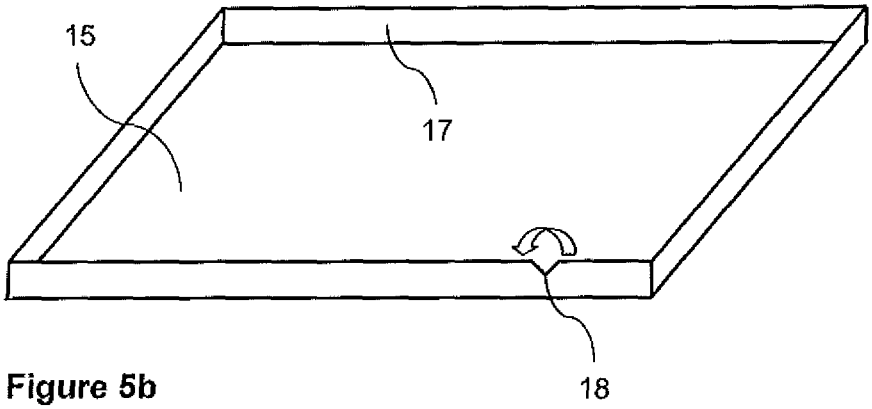
FIG. 5*b* shows an exemplifying form of embodiment of a cage roof with drain and overflow protection.
Figure 5C:
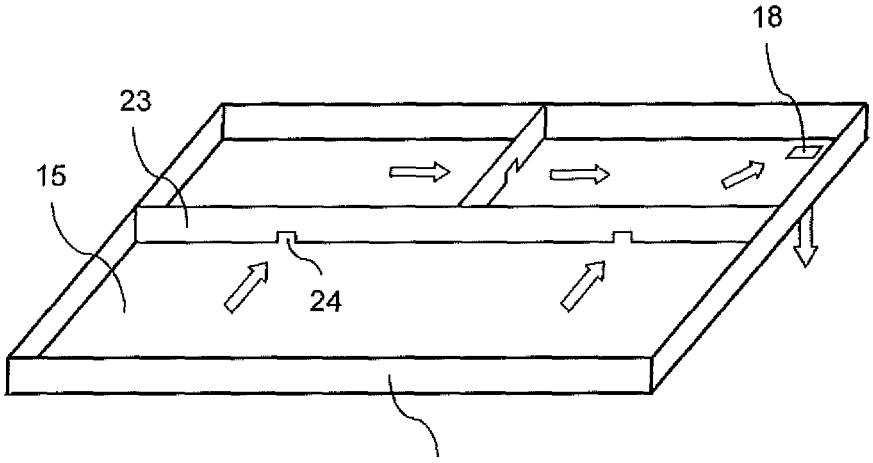
FIG. 5*c* shows an exemplifying form of embodiment of a cage roof with drain, overflow protection and separating elements.

Different exemplifying forms of embodiment of the cage roof 15 with accessories are illustrated in FIGS. 5*a*, 5*b* and 5*c*. Generally, the cage roof 15 has a seal and a drain 18 as shown in FIG. 5*a*.

FIG. 5*b* shows a cage roof 15 with an overflow protection means 17 which is arranged at side edges of the cage roof 15 and completely surrounds this. The drain 18 is formed as a notch in the overflow protection means 17.

FIG. 5*c* shows a cage roof 15 with an overflow protection means 17 and with separating elements 23 which divide up the cage roof 15 into a plurality of sectors. Throughflow openings 24 are formed in the separating elements 23 so that extinguishing water can flow from each sector in the direction of the drain 18. The drain 18 can be formed as a rectangular opening in the cage roof 15 or also be of any other desired suitable form such as, for example, round or polygonal.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator cage for a fire service elevator, the elevator cage comprising:

a cage roof, the cage roof having a surface extending in a substantially horizontal direction;

a drain arranged in a seal at the horizontal surface of the cage roof, the drain being arranged to drain away water from the cage roof, the seal covering substantially an entire area of the cage roof; and a plurality of separating elements arranged on the cage roof, the separating elements dividing the cage roof into a plurality of sectors, the separating elements comprising respective openings for flow of water.

2. The elevator cage of claim 1, further comprising an overflow protection, the overflow protection being arranged at the cage roof to prevent water from flowing off one or more sides of the cage roof.

3. The elevator cage of claim 2, the drain comprising an opening in the cage roof and in the seal.

4. The elevator cage of claim 2, the drain comprising a notch in the overflow protection.

5. The elevator cage of claim 2, the drain comprising an opening in the cage roof and in the seal.

6. The elevator cage of claim 5, the opening being arranged at least partially at the overflow protection.

7. The elevator cage of claim 1, further comprising a guide element coupled to the drain.

8. The elevator cage of claim 7, the guide element emptying into the elevator cage.

9. The elevator cage of claim 7, the guide element extending past a lower end of the elevator cage.

10. The elevator cage of claim 1, further comprising a sealed floor.

11. The elevator cage of claim 10, further comprising a cage apron configured to guide water from the sealed floor.

12. The elevator cage of claim 1, the seal being the horizontal surface of the cage roof.

13. The elevator cage of claim 1, the seal comprising a sealing element arranged above or below the cage roof.

14. A fire service elevator, comprising:

an elevator cage, the elevator cage comprising, a cage roof, the cage roof having a surface extending in a substantially horizontal direction, a drain arranged in a seal at the horizontal surface of the cage roof, the drain being arranged to drain away water from the cage roof, the seal covering substantially an entire area of the cage roof, and a plurality of separating elements arranged on the cage roof, the separating elements dividing the cage roof into a plurality of sectors, the separating elements comprising respective openings for flow of water.

15. An elevator cage for a fire service elevator, the elevator cage comprising:

a cage roof having a surface extending in a substantially horizontal direction;

a drain arranged in a seal at the horizontal surface of the cage roof, the drain being arranged to drain away water from the cage roof; and a plurality of separating elements arranged on the cage roof, the separating elements dividing the cage roof into a plurality of sectors, the separating elements comprising respective openings for flow of water on the seal to flow to the drain.

* * * * *